US005591305A

United States Patent [19]

Cameron

[11] Patent Number: 5,591,305

[45] Date of Patent: Jan. 7, 1997

[54] IMPRINTING FELT AND METHOD OF USING THE SAME

[75] Inventor: John H. Cameron, Appleton, Wis.

[73] Assignee: The James River Corporation of Virginia, Richmond, Va.

[21] Appl. No.: 415,048

[22] Filed: Mar. 31, 1995

Related U.S. Application Data

[62] Division of Ser. No. 252,449, Jun. 1, 1994.

[51] Int. Cl.[6] ..... D21H 11/00

[52] U.S. Cl. ..... 162/117; 162/109; 162/111

[58] Field of Search ..... 162/109, 117, 162/113, 111, 188; 428/154

[56] References Cited

U.S. PATENT DOCUMENTS

| | | | |
|---|---|---|---|
| 1,536,533 | 5/1925 | Sheehan . | |
| 2,038,712 | 4/1936 | Brodin . | |
| 3,059,312 | 10/1962 | Jamieson . | |
| 3,102,836 | 9/1963 | Griswold . | |
| 3,301,746 | 1/1967 | Sanford et al. . | |
| 3,399,111 | 8/1968 | Beaumont et al. . | |
| 3,537,954 | 11/1970 | Justus . | |
| 3,549,742 | 12/1970 | Benz . | |
| 3,617,442 | 11/1971 | Hurschman . | |
| 4,251,928 | 2/1981 | Rotar et al. . | |
| 4,271,222 | 6/1981 | Hahn . | |
| 4,300,982 | 11/1981 | Romanski . | |
| 4,357,386 | 11/1982 | Luciano et al. . | |
| 4,421,600 | 12/1983 | Hostetler . | |
| 4,440,597 | 4/1984 | Wells et al. | 162/111 |
| 4,514,345 | 4/1985 | Johnson et al. | 264/22 |
| 4,528,239 | 7/1985 | Trokan | 428/247 |
| 4,529,643 | 7/1985 | Lundstrom . | |
| 4,533,437 | 8/1985 | Curran et al. . | |
| 4,571,359 | 2/1986 | Dutt . | |
| 4,657,806 | 4/1987 | Dutt . | |
| 4,830,905 | 5/1989 | Gulya et al. . | |
| 4,834,838 | 5/1989 | Klowak | 162/111 |
| 4,868,032 | 9/1989 | Eian et al. . | |
| 4,931,010 | 6/1990 | Barnwell . | |
| 4,981,745 | 1/1991 | Lefkowitz | 428/147 |
| 5,156,843 | 10/1992 | Leong et al. . | |
| 5,207,873 | 5/1993 | Sandieja et al. . | |
| 5,232,768 | 8/1993 | Eklund et al. . | |
| 5,328,757 | 7/1994 | Kenney et al. . | |
| 5,346,567 | 9/1994 | Barnwell . | |

FOREIGN PATENT DOCUMENTS

| | | | |
|---|---|---|---|
| 1455843 | 4/1974 | United Kingdom | 162/900 |
| 9210607 | 6/1992 | WIPO | 162/900 |

*Primary Examiner*—Brenda A. Lamb
*Attorney, Agent, or Firm*—Finnegan, Henderson, Farabow, Garrett & Dunner, L.L.P.

[57] ABSTRACT

The felt disclosed is a base fabric which is covered with a low level of batting and which is treated with a polymer. A papermaking machine and method of using the machine which employs a felt that simultaneously imprints and dewaters a wet paper web as the web is deposited on a cylindrical drying surface.

6 Claims, 6 Drawing Sheets

IMPRINTING FELT AND METHOD OF USING THE SAME

This is a division of application Ser. No. 08/252,449, filed Jun. 1, 1994.

BACKGROUND

1. Field of the Invention

The invention relates to an improved imprinting felt for use in the production of paper. The imprinting felt of the present invention contains a low level of sheet side batting and is treated with a polymer. Sheet side refers to the side of the felt which contacts the wet paper web during manufacture.

The invention further relates to an improved papermaking process using the imprinting felt. The imprinting felt of the present invention simultaneously pattern presses and dewaters the paper web.

The invention also relates to an improved paper product produced using the improved papermaking process. The paper produced according to the present invention has increased paper bulk and absorbency without having reduced strength.

2. Background of the Invention

Papermaking processes for manufacturing paper webs for use as, or in the production of tissue, towel, and sanitary paper products require the removal of water from the paper web. There are two major types of machines used for the production of these products. One type is the conventional wet press machine which is generally represented by a wet fibrous web being deposited on a Fourdrinier wire, drained with or without the aid of vacuum, transferred to a press felt and pressed onto a cylindrical drying surface. After drying, the web is creped from the drying surface and processed through a series of converting steps which may include embossing, application of glue, and lamination to form a multilayer product.

The felt used in conventional wet pressing is composed of a woven base fabric covered with batting. The base fabric provides a support for the batting and allows stable running of the felt on the paper machine. The batting material is normally a fine cut nylon filament that is needle punched onto the base fabric. The batting provides water holding capacity, forms fine capillaries that reduce the amount of rewet as the wet web exits the pressure nip and protects the base fabric from excessive machine wear.

It is important in conventional wet pressing operations, that the wet web be uniformly pressed onto the surface of the cylindrical drying surface, hereinafter referred to as a Yankee dryer. The uniform pressing of the wet web has both beneficial and detrimental effects on the drying process and paper structure. Uniform pressing reduces the amount of water that needs to be evaporated during drying of the paper web. It increases the drying rate and consolidation of the web structure, thus increasing the paper strength, but reducing the bulk and absorbency of the dried paper.

The other major type of papermaking machine for the production of absorbent and bulky paper is represented by the through-air-drying machines, one representation of which is described in U.S. Pat. No. 3,301,746 to Sanford et al., which is incorporated by reference in its entirety herein. In the process disclosed in Sanford et al., the wet paper web is pressed onto the imprinting fabric. An imprinting felt is a fabric that imprints a knuckle type pattern onto the paper web. For the purposes of the present invention, felt is understood to include a press fabric both with and without batting. After the web is placed onto an imprinting felt, it is pre-dried in an air-through-dryer. The partially dried paper web is pressed by the imprinting fabric onto the surface of the cylindrical dryer/yanker without disturbing the imprinted knuckle pattern. By contrast to the conventional wet pressing process, which uses an overall pressing, the web in Sanford et al. is pressed with the fabric knuckle pattern. While water removal and drying rates are reduced due to the non-uniform pressing, the absorbency and bulk of the paper are increased.

While the through-air-drying process of Sanford et al. increases the bulk, absorbency and softness of the paper produced, it has the drawbacks of being more complex, less efficient than conventional drying processes, and not easily implemented with existing papermaking machines.

Conventional wet pressing and through-air-drying may be considered the two extremes for the production of towel, tissue, and sanitary paper products. Others have proposed processes that represent middle grounds of these two extremes. One such process is disclosed in U.S. Pat. No. 3,537,954 to Justus, which is incorporated by reference in its entirety herein. Justus describes two methods for imprinting a knuckle pattern on a wet fiber web and depositing the web on the surface of a dryer cylinder. The first method requires using a secondary fabric to imprint the knuckle pattern onto the web after it has been uniformly pressed on the dryer surface with a conventional felt. The second method employs an imprinting fabric containing monofilament filler (batting) between the imprinting fabric strands to increase the uniformity of contact with the dryer surface.

The methods of Justus are directed to solving the problems associated with uniformity in pressing the wet web onto the dryer surface. The methods of Justus suffer from the drawback that since the imprinting fabric is not uniformly covered with a batting, water is not effectively removed from the wet web as it is pressed on the dryer surface. Because of the lack of batting, less water can be removed from the wet web during pressing and more water reenters the web as it exits the press nip.

To solve the problems inherent in Justus and to improve water removal with an imprinting fabric, U.S. Pat. No. 4,533,437 to Curran et al. discloses a method whereby the imprinting fabric was covered with batting levels greater than 153 g/m$^2$. While batting less than 162 g/m$^2$ does provide greater increases in bulk and absorbency as disclosed in Curran et al., Curran et al. does recognize that the batting level could not be reduced significantly below 162 g/m$^2$ and still adequately dewater the paper. Batting levels between 152 and 162 g/m$^2$ appear to increase absorbency and bulk, but do not provide acceptable dewatering. In addition to causing low productivity, fabrics with low levels of batting (for example, 150 g/m$^2$) are difficult to run on a paper machine because of pulp entangling with loose batting.

Alternative solutions to the dewatering problem have taken the form of modifying the fabric or batting. U.S. Pat. No. 3,617,442 to Hurschaman discloses that conventional batting may be replaced by a synthetic, open-celled, flexible foam, such as polyurethane. The use of foam was disclosed to provide ease of manufacture of the fabric and the extension of fabric life. In another alternative, U.S. Pat. No. 4,571,359 to Dutt discloses that the base fabric could be covered with relatively large polymeric resin particles fused together to form a porous covering. The disclosed particles are from 0.15 mm to 5.0 mm in diameter. The particles were disclosed to be fused together and to the base fabric forming a covering thereover.

The present invention overcomes the disadvantages associated with the prior art. According to the present invention, the papermaking process can be carried with low levels of batting on the imprinting felt, thereby improving the bulk and absorbency of the paper product while maintaining a sufficiently high level of dewatering of the wet paper web.

SUMMARY OF THE INVENTION

Further advantages of the invention will be set forth in part in the description which follows and in part will be apparent from the description, or may be learned by practice of the invention. The advantages of the invention may be realized and attained by means of the instrumentalities and combinations particularly pointed out in the appended claims.

To achieve the foregoing advantages and in according with the purpose of the invention, as embodied and broadly described herein, there is disclosed:

An imprinting felt for use in the production of paper including a base fabric having a sheet side batting of from about 0 to about 150 g/m$^2$ having applied thereto a polymer in an amount of from about 1% to about 50% based upon the combined weight of the base fabric and sheet side batting.

There is also disclosed:

An imprinting felt for use in the production of paper, including a base fabric having a sheet side batting which has a polymer applied thereto, wherein the combined weight of the sheet side batting and polymer is less than 150 g/m$^2$.

There is further disclosed:

A press felt for the production of paper including a base fabric having a batting applied thereto which is further treated with polytetrafluoroethylene in an amount of from about 1% to about 50% of the total weight of the base fabric and batting on both sides thereof.

There is also disclosed:

A method of making a paper base sheet including applying a wet web to an imprinting felt, wherein the imprinting felt has a sheet side batting in an amount of from 0 to about 150 g/m$^2$ and which felt has been treated with a polymer in an amount of from 1% to about 50% by weight of the fabric and batting; pressing the wet web onto a dryer surface; and removing the web from the dryer surface.

Finally, there is disclosed:

A paper base sheet produced by the method using the imprinting felt as described above.

A press felt is a fabric traditionally used to contact a wet paper web and dewater the wet web. An imprinting felt is a press felt which is further used to impart a pattern to the wet paper web. An imprinting felt is woven to create areas which stand out and thus form a pattern of knuckles adjacent to the web contacting side of the felt. As the imprinting felt contacts a wet paper web either prior to or upon application of the wet web to the surface of a cylindrical dryer, the knuckles on the felt densify the wet paper web to a greater degree than does the felt surrounding the knuckles; thus, imprinting the pattern from the felt to the wet paper web.

It is well known that the use of an imprinting felt with a low level of batting is capable of producing a paper product with improved water absorbency and bulk. However, as the batting level on the press felt is reduced, the dewatering efficiency of the press felt decreases. At levels on the sheet side of 162 g/m$^2$ of batting or less, the dewatering efficiency of the press felt is so poor that the use of such a felt is uneconomical.

Although the imprinting felt increases sheet bulk, it also increases water load to the Yankee dryer, which results in an economically unacceptable decrease in machine speed. This increase in water loading associated with the imprinting felt has required the sheet side batting level to be at least 162 g/m$^2$ as described in U.S. Pat. No. 4,533,437 to Curran et al., at column 9, lines 30 to 50. The present invention allows the felt batting level to be reduced well below this limit while still providing acceptable dewatering and superior sheet bulk and absorbency.

Additional advantages of the invention will be set forth in part in the description which follows, and in part will be apparent from the description, or may be learned by practice of the invention. The objects and advantages of the invention will be realized and attained by means of the elements and combination particularly pointed out in the appended claims.

The accompanying drawings, which are incorporated in and constitute a part of the specification, illustrate various aspects of the invention and, together with the description, serve to explain the principles of the invention.

DETAILED DESCRIPTION

Figure 1:
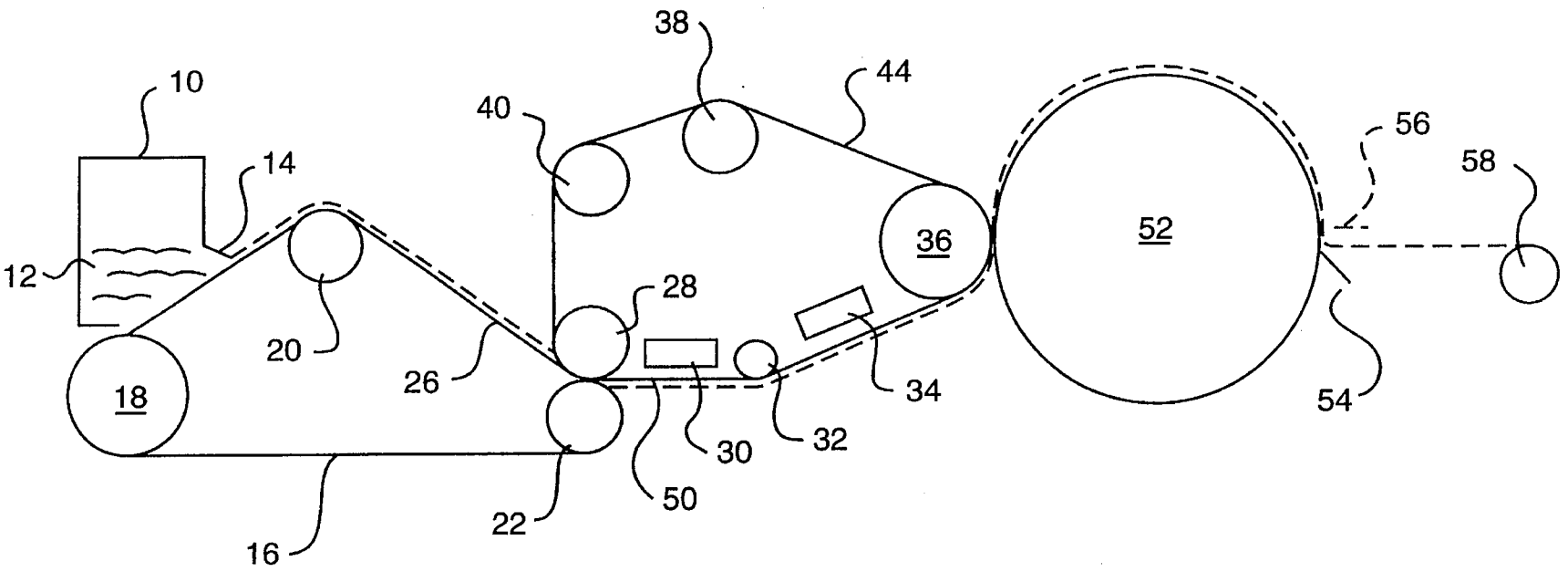
FIG. 1 is schematic side elevation view of a papermaking apparatus for use with the imprinting felt and method of the present invention.

The present invention involves an improved press felt for the manufacture of tissue, towel and sanitary paper products. The papermaking machine and process employs this improved felt which comprises a base fabric having a low weight of batting applied thereto and which also has a polymer applied thereto. This polymer treated imprinting felt produces an extremely bulky, absorbent, light weight paper without an unacceptable loss in productivity.

In traditional papermaking processes, the solids content of the wet web after application to the drying cylinder but before water evaporation is typically between 30 and 45% solids. In order to retain the economies of the traditional process, the dryer must be maintained at sufficient speed, which speed cannot be maintained if the percent solids of the wet web is below about 30% before water evaporation on the drying cylinder. The imprinting felt of the present invention although having low levels of batting can maintain the percent solids content of the wet web above about 30% before water evaporation on the drying cylinder.

More preferably, the imprinting felt of the present invention can dewater the wet web to a solids content of between 35 and 45% before application of the wet web to the drying cylinder. Thus, the imprinting felt of the present invention allows paper to be produced without a substantial increase in the amount of water that needs to be evaporated. The improved felts of the invention further allow paper to be produced without the paper fibers entangling with loose batting on the imprinting felt.

In the papermaking process according to the present invention, the paper web can be formed either directly on the imprinting felt or on a separate wire and transferred to the imprinting felt.

In the imprinting felt according to the present invention, the base fabric may preferably be selected from, but not limited to, nylon, polyester, acrylic or metallic wire. The base fabric is more preferably woven from nylon. The base fabric has applied thereto a batting. The batting may be produced of materials and by methods which are recognized by the skilled artisan. The batting is preferably formed from finely chopped nylon fibers which are needle punched through the base fabric.

In one embodiment of the present invention, the base fabric has applied thereto on the sheet side, a batting at a weight which is preferably less than 150 grams per square meter. The batting is more preferably applied at a weight of from about 0 to about 150 g/m$^2$, even more preferably at a weight of from about 0 to about 100 g/m$^2$, and most preferably from about 50 to about 130 g/m$^2$.

In another preferred embodiment, the total weight of the batting and polymer treatment is from about 15 to about 150 g/m$^2$, preferably from about 50 to about 130 g/m$^2$, and more preferably from about 50 to about 100 g/m$^2$.

According to the present invention, the press felt or imprinting felt is treated with a polymer which can either be applied as a coating to the felt or which can be applied in such a manner that it partially fills the internal voids within the felt. The weight of the polymer applied may be from about 1 to about 50% of the combined weight of the base fabric plus the batting. The polymer is preferably applied in an amount of from 1 to about 30% by weight, and more preferably from about 5 to 15% by weight, most preferably from about 6 to 8% by weight. The skilled artisan will recognize that the polymer is applied in an amount which will allow the fabric structure to be closed sufficiently to allow water retention, while not being overclosed which will result in unacceptable low water removal. The fabric must be closed sufficiently to achieve capillary size distribution which can result in dewatering of the wet paper web to a solids content of from about 30% to about 50%.

The polymer may be either a synthetic polymer resin or a synthetic polymer. The polymer is preferably selected from the group consisting of polyurethane, polytetrafluoroethylene, polyethylene, polyamide, and polyamide resins.

In one alternative to this invention the imprinting pattern does not result from the underlying base fabric strands but instead is formed directly into the imprinting through shaping of the polymer or polymer-batting composite. This may be accomplished by non-uniformly applying the polymer treatment in such a manner as to create a pattern, or by uniformly applying the polymer treatment and then removing or densifying part of the surface of the felt to create the desired pattern.

In one alternative embodiment of the present invention, press felt having a batting level which is in excess of 150 g/m$^2$, more closely related to traditional non-imprinting felts, has been treated with polytetrafluoroethylene. This polymer treated press felt may not form an imprinted pattern in the paper web and thus may be used in conjunction with an imprinting mechanism, but this press felt which has been treated with polytetrafluoroethylene has improved dewatering characteristics.

The press felt and imprinting felt of the present invention are used to form paper products which have improved characteristics over the prior art paper products produced using traditional papermaking machines and processes. The paper product of the present invention is a fibrous web product, formed by deposition from an aqueous slurry of cellulosic fibers, bonded together to form a web. The fibers can be selected from well recognized fibers which include all wood fibers. The wood fibers which are preferably used in the present invention are kraft fibers, including, but not limited to, northern hard wood kraft, northern soft wood kraft, southern hard wood kraft, and southern soft wood kraft.

The web preferably has a basis weight of about 5 to 50 lbs per 3000 sq ft, geometric-mean dry and geometric-mean wet tensile in grams (force) per three inches width, an apparent bulk in cubic centimeters per gram-weight and a water absorbency of grams water absorbed per gram dry solids. When the press felt and imprinting felt of the present invention are used, bulk increases 10 to 20% and water absorbency increases 10 to 20% at no loss in strength.

The improved imprinting felt of the present invention may be used with any of the art recognized paper forming machines. These machines include, but are not limited to Fourdrinier formers, twin wire formers, suction breast roll formers and crescent formers.

FIG. 1 shows one type of papermaking machine suitable for utilizing the imprinting felt of the present invention. In FIG. 1, 10 is the head box; 12 is the diluted stock; 14 is the stock flow to the wire; 16 is the forming wire; 18, 20, and 22 are forming wire rolls which support, drive and guide the forming wire; 24 is the wet paper web on the forming wire; 26 is the forming wire, which is now supporting the wet web; 28 is the vacuum transfer roll used to help transfer the wet paper web to the imprinting felt; 30 and 34 are vacuum dewatering boxes; 32, 36, 38, and 40 are rolls used to guide, move and support the imprinting felt; 44 is the imprinting felt; 52 is the Yankee dryer; 54 is the crepe blade; 56 is the dried paper web after creping; and 58 is the reel onto which the dried paper web is wound.

In this papermaking machine the wet web 24 flows from the headbox 10 onto the forming fabric 26. The percent solids of the wet web on the forming fabric is normally in the range of 5% to 15% solids. The wet web is transferred, with the aid of a vacuum roll 28 if required, to the imprinting felt 44. The initial percent solids of the web on the imprinting felt is about 10 to 15%. In one embodiment of the present invention, vacuum may be applied in a series of slots 30 and 34 to increase the percent solids of the wet paper web and remove excess water from the imprinting felt. The application of vacuum to the imprinting felt as shown in FIG. 1 will increase the percent solids of the wet paper web to about 20% to 30% solids. Using a pressure backing roll 36, the paper web is pressed onto the surface of the dryer 52.

In a preferred embodiment, differential transfer speeds, where the imprinting felt speed is about 0 to 10% slower than the speed of the forming wire, may be used. From this point the web travels with the rotating dryer surface and is removed from the dryer with a crepe blade 54. The creped dried paper is at about 95% to 100% solids and is then wound on the reel 58.

Figure 2:
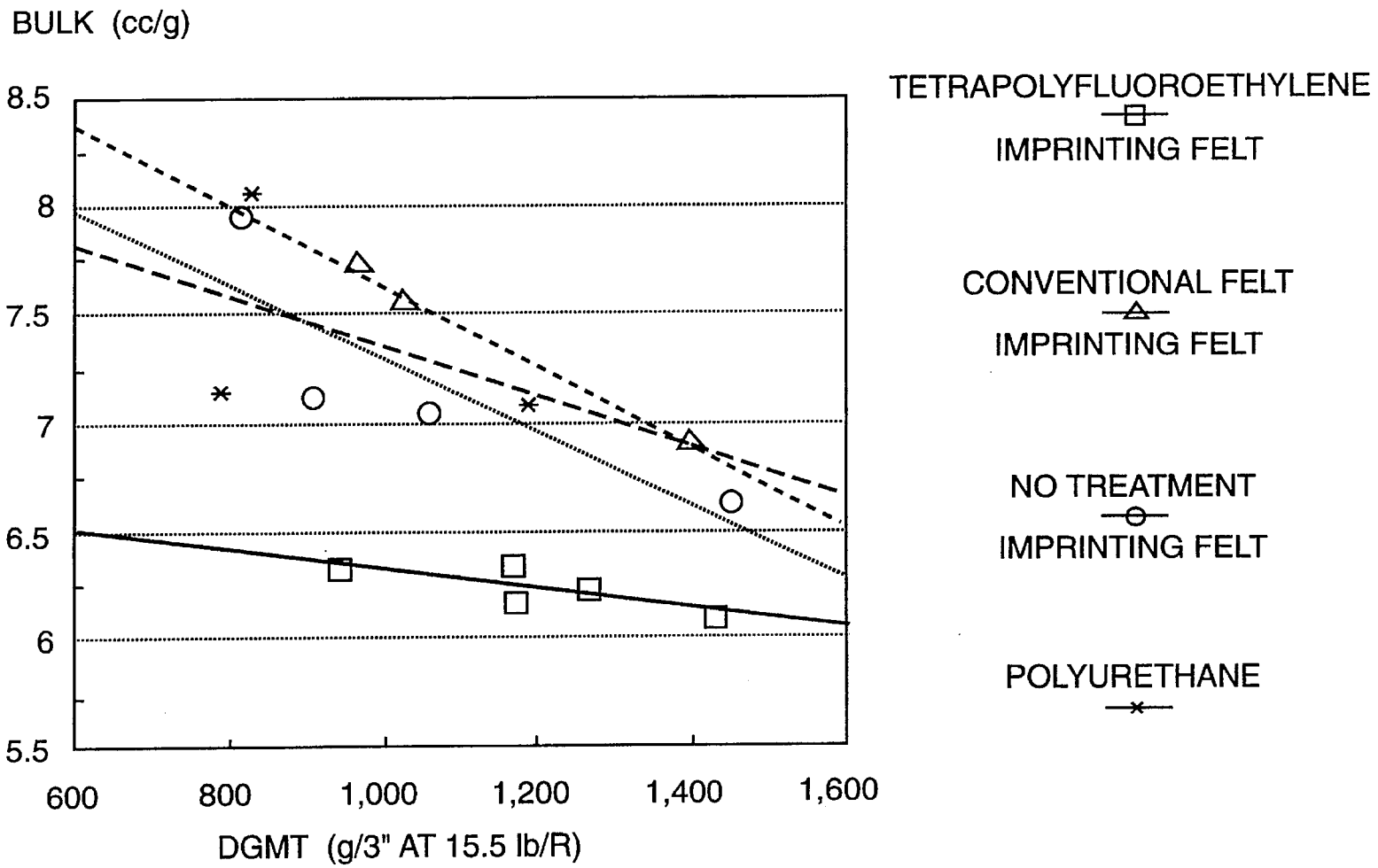
FIG. 2 is a graph which illustrates the effect of imprinting felts on creped sheet bulk as a function of sheet strength.

The effect of the imprinting felts with low levels of batting on sheet bulk is shown in FIG. 2. This figure shows that the use of these imprinting felts increases bulk by as much as 30%. Both the untreated imprinting felt and the polymer treated imprinting felt tend to produce similar increases in bulk.

The use of the polymer treatment on the imprinting felt and the use of vacuum applied to the wet web on the imprinting felt significantly increases the dewatering ability of the imprinting felts and enables an imprinting felt to be used without a significant increase in water load on the wet web to the Yankee dryer.

Figure 3:
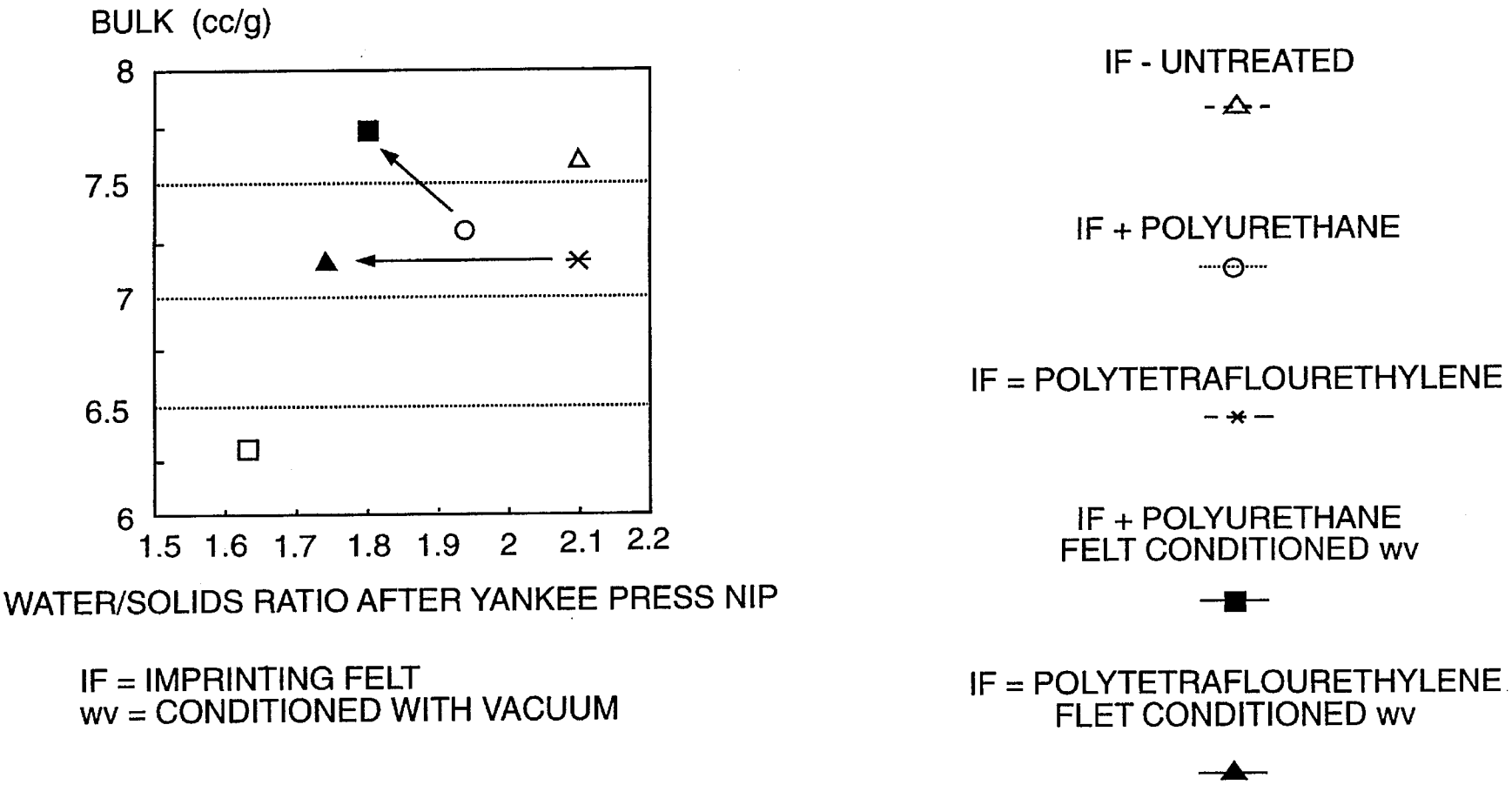
FIG. 3 is a graph which illustrates the effect of the process according to the present invention on bulk and water load to the Yankee dryer.

In FIG. 3, the water/solids ratio of the wet web immediately after being pressed on the Yankee dryer is plotted against creped sheet caliper for a 15.5 lb/3000 sq ft dry sheet at a geometric mean tensile of 1000 g/3-inches. Use of the imprinting felt increases the sheet caliper by about 20%. Without a polymer treatment or without vacuum and the polytetrofluoroethylene (Teflon®) treatment, use of the imprinting felt increases sheet caliper but also increases the water/solids ratio of the web on the Yankee dryer by about 30%. With the polyurethane treatment and without vacuum, the sheet's caliper is still increased by about 20% and the water/solids ratio of the web on the Yankee is increased by about 20%. With either polymer treatment or the application of vacuum, the sheet's caliper is still increased by about 20% and the water/solids ratio of the web on the Yankee is increased by 10% or less.

FIG. 3 shows that using polymer treated imprinting felts can increase sheet bulk by about 20% with only a slight increase in water load of the web on the Yankee dryer. The process of the present invention provides an increase in bulk of the resultant sheet without a significant decrease in production rate.

Figure 4:
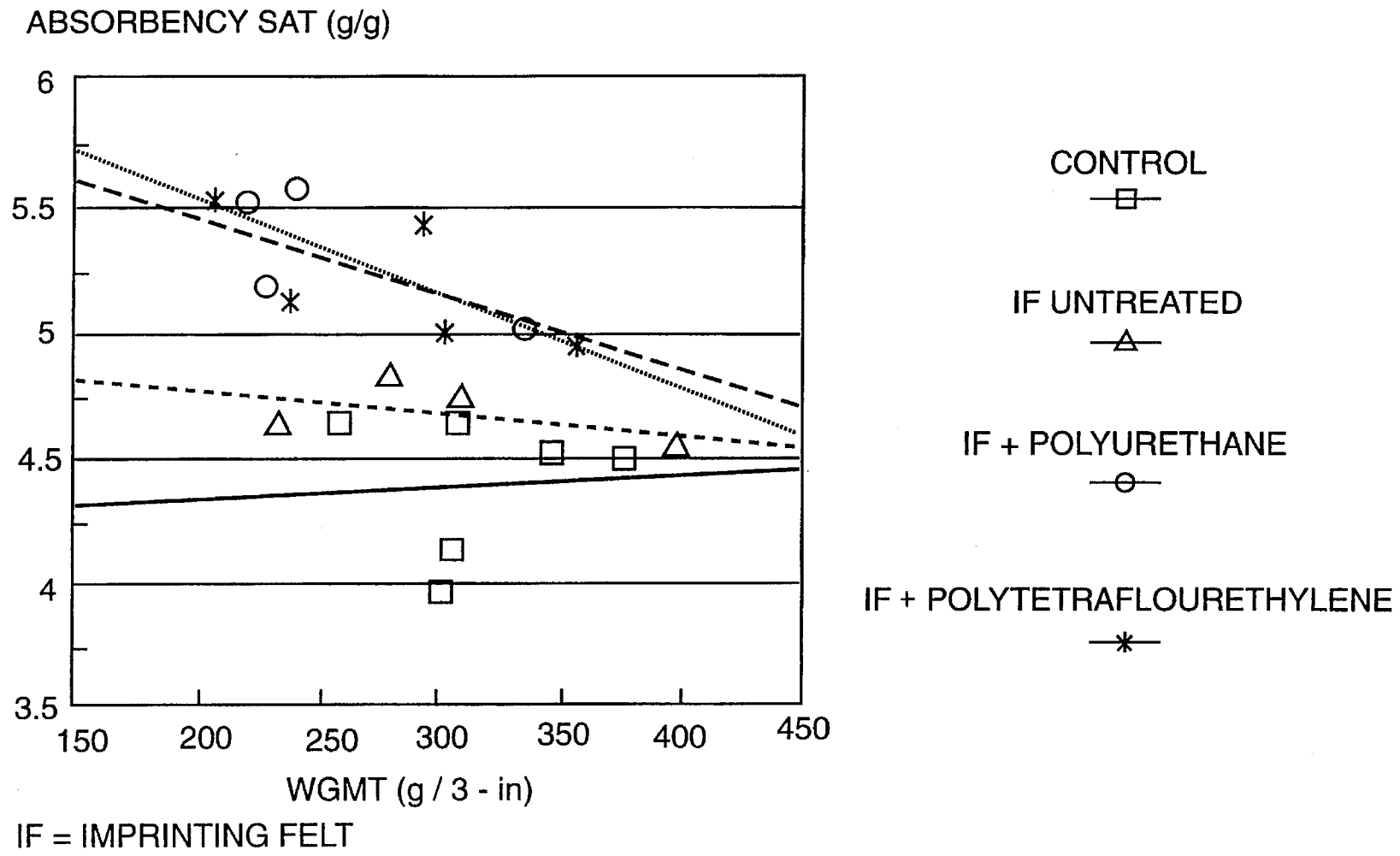
FIG. 4 is a graph which illustrates the effect of imprinting felts on creped sheet water absorbency as a function of wet sheet strength.

FIG. 4 shows sheet absorbency in terms of grams of water absorbed per gram of solids versus wet geometric mean tensile for a paper produced by pressing with a conventional press felt and imprinting felts with different polymer treatments. This figure illustrates that sheet absorbency can be increased by as much as 25% when pressing the sheet with an imprinting felt compared to pressing the sheet with a conventional felt. As illustrated in this figure, the use of the polymer treatments on the imprinting felt significantly increases the absorbency of paper product produced therewith. Paper produced with an untreated imprinting felt has only slightly more absorbency than paper produced with a conventional felt; whereas, paper produced with a polymer treated imprinting felt has significantly higher absorbency than paper produced with either an untreated imprinting felt or paper produced with a conventional felt.

Figure 5:
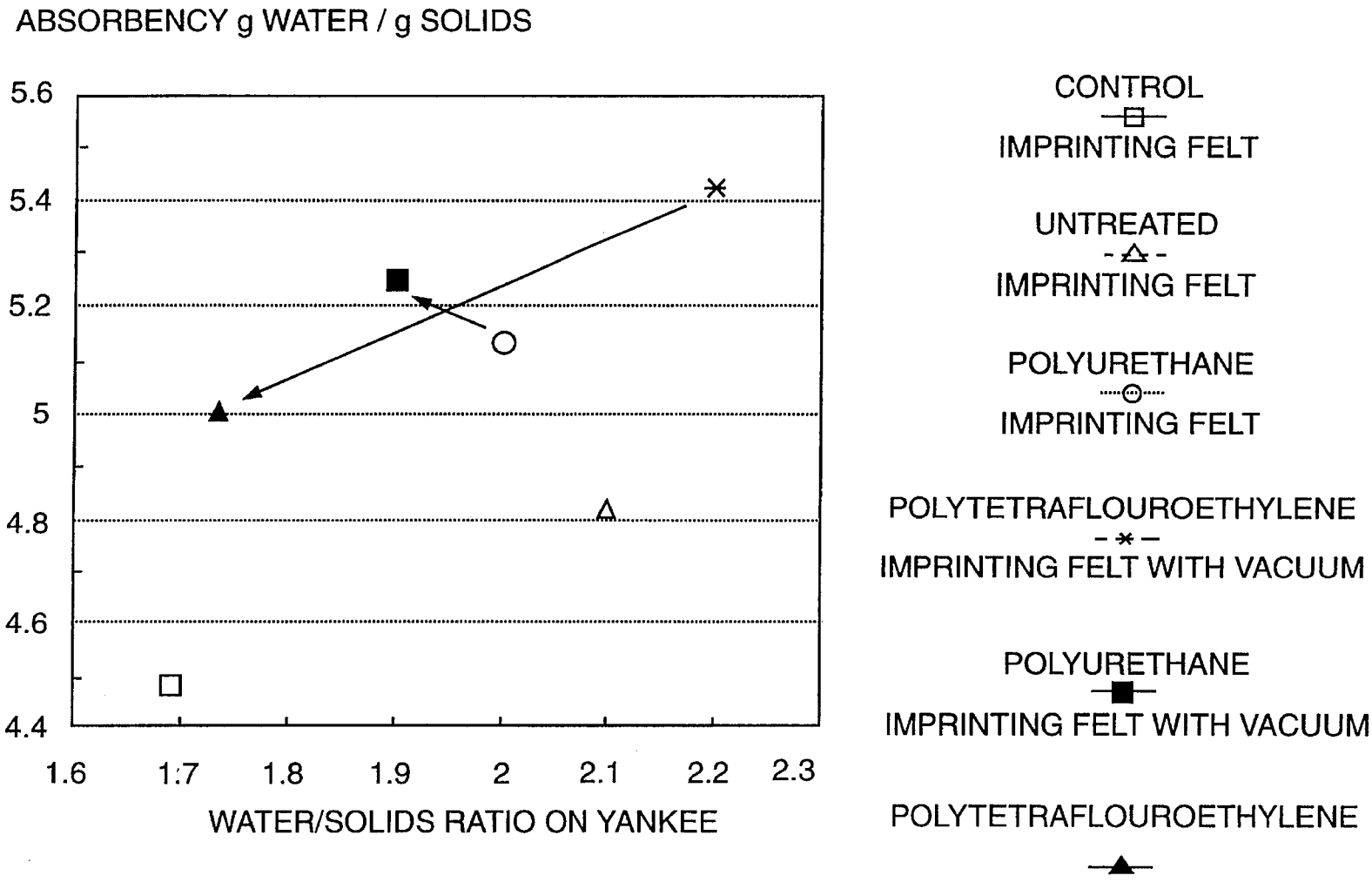
FIG. 5 is a graph which illustrates the effect of the process according to the present invention on sheet absorbency and water load to the Yankee dryer.

FIG. 5 shows the effect of the polymer treatments and vacuum on water/solids ratio and sheet absorbency of the web. The absorbency in this figure is given for a 15.5 lb/3000 sq ft sheet and a wet geometric mean tensile of 300 g/3-in. This figure illustrates that the use of the polymer treatments and vacuum can produce a sheet with a significant improvement in absorbency without significantly increasing the water/solids ratio of the web on the Yankee dryer. Using the untreated imprinting felt only slightly increased sheet absorbency over conventional pressing felt.

At low levels of batting, it is more difficult to entangle the batting with itself and the underlying base-imprinting fabric. At sheet side batting levels of 150 g/m$^2$ or less the sheet side batting is not as securely bonded to the base fabric as at higher batting levels. This loose batting tends to entangle with the paper fibers. These entangled paper fibers produce weak spots in the paper web as it is pressed on the Yankee dryer. This results in an unacceptable product. The use of a polymer treatment with an imprinting felt that has a low level of batting helps to secure the batting fibers together and to the base fabric. This allows the use of a felt with very low batting levels without the wet paper fibers entangling with loose batting fibers. In addition to securing low levels of sheet side batting to the base fabric, the use of the polymer treatment enables using press felts with low sheet side batting levels to effectively dewater the paper web during pressing on the Yankee dryer.

Figure 6:
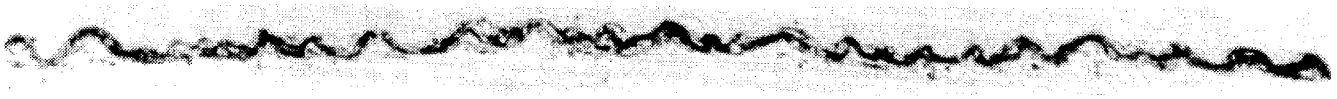
FIG. 6 is a photomicrograph of a cross section of a paper sheet produced with a conventional wet pressing process.
Figure 7:
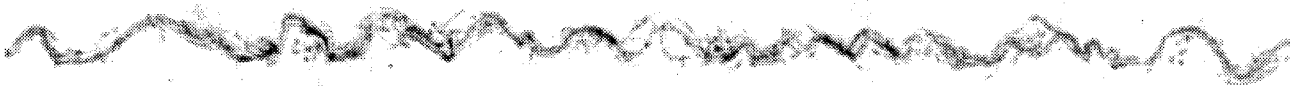
FIG. 7 is a photomicrograph of a cross section of a paper sheet produced according to the present invention.

FIG. 6 is a photomicrograph of a cross section of a paper sheet produced with a conventional press felt. FIG. 7 is a photomicrograph of a cross section of a paper sheet produced with one of the improved imprinting felts of the present invention coated with polyurethane. As can be readily seen in these photomicrographs, the use of the improved imprinting felt produces a more open sheet structure. The imprinting felt creates numerous voids within the sheet. These voids result in a very open and absorbent paper.

The use of the polymer treatments allows the batting level of the felt to be reduced to a level where the sheet properties are optimized without an unacceptable increase in water load to the Yankee dryer.

The following examples are not to be construed as limiting the invention as described herein.

EXAMPLES

Examples of the use of the polymer-treated imprinting felts are given below.

The examples describe trials on both Fourdrinier and Crescent Forming paper machines. The Fourdrinier machine is described in reference to FIG. 1, above. A Crescent former and some of the differences between a Crescent former and Fourdrinier machine are set forth below.

The major difference between a Fourdrinier machine and Crescent former is that in the Fourdrinier machine the paper web is formed on a forming wire and transferred, after formation, to the pressing felt, while in a Crescent former the sheet is formed between a wire and a felt and leaves the forming section on the felt. Therefore, as opposed to the Fourdrinier machine, with the Crescent former there is no sheet transfer to the pressing felt. After the sheet is on the pressing felt, both types of machine press the sheet onto the Yankee dryer in substantially similar manners.

EXAMPLE 1

On a pilot machine as depicted in FIG. 1, a polytetrafluoroethylene treated imprinting felt was used to make a highly absorbent paper. The machine conditions were as follows:

| | |
|---|---|
| Type: | Fourdrinier with Yankee dryer |
| Speed: | 100 ft/min |
| Imprinting Felt Width | 14 inches |
| Imprinting Felt Length | 19.5 ft |

The base fabric, used for the imprinting felt, was a 750 g/m$^2$ triple layer nylon woven fabric with about 100 g/m$^2$ of 20 micron in diameter nylon batting applied to both sides of the base fabric. The basic fabric was woven to create a prominent knuckle in the CD (cross-direction) with the CD strands going over 2 MD strands and then under 2 MD (machine-direction) strands. The base fabric had a CD strand count on the sheet side of 19 per inch. This fabric was saturated with a water dispersion of sub-micron polytetrafluoroethylene (Teflon®) particles and air dried. The total weight of Teflon® added was about 87 g/m$^2$.

This fabric was run on the Fourdrinier machine with a furnish containing 70% Northern Hardwood Kraft fiber and 30% Northern Softwood Kraft fiber. To determine the effect of this fabric on paper sheet properties and productivity, a control fabric was also run. The control fabric was a conventional felt with high batting levels and no polymer treatment.

To achieve good sheet dewatering during pressing on the Yankee dryer 52, the treated imprinting felt was conditioned by passing the imprinting felt with the wet paper sheet attached over a vacuum dewatering box 30 or 34. The paper sheet solids were measured after pressing the wet sheet on the hot Yankee dryer 52.

After drying on the Yankee 52, the sheet were creped off the Yankee. The physical properties of the creped sheets are shown below.

TABLE 1

| Property | Control | Treated Imprinting Felt |
|---|---|---|
| Basis Weight lb/3000 sq ft | 15.1 | 14.7 |
| MD dry tensile g/3-inch | 1,774 | 1,831 |
| CD dry tensile g/3-inch | 892 | 737 |
| MD wet tensile g/3-inch | 485 | 500 |
| CD wet tensile g/3-inch | 205 | 183 |
| Caliper mils/8-sheets | 50.75 | 54.9 |
| Water Absorption g water/g solids | 4.3 | 5.0 |
| Hot Yankee Solids % solids | 36.3 | 36.5 |

As shown in the above Table 1, the treated imprinting felt substantially increases both water absorption and bulk without a decrease in productivity or a significant loss in paper strength.

EXAMPLE 2

On a pilot machine, a polyurethane treated imprinting felt was used to make a highly absorbent paper. The base fabric and batting levels were the same as Example 1, with the sheet side treated with about 70 g/m$^2$ polyurethane. The furnish and machine conditions are the same as those described in Example 1.

The properties of the paper produced with this treated imprinting felt and those produced with the control felt are listed below.

TABLE 2

| Property | Control | Treated Imprinting Felt |
|---|---|---|
| Basis Weight lb/3000 sq ft | 15.1 | 15.76 |
| MD dry tensile g/3-inch | 1,774 | 1,663 |
| CD dry tensile g/3-inch | 892 | 779 |
| MD wet tensile g/3-inch | 485 | 550 |
| CD wet tensile g/3-inch | 205 | 173 |
| Caliper mils/8-sheets | 50.75 | 65.6 |
| Water Absorption g water/g solids | 4.3 | 5.5 |
| Hot Yankee Solids % solids | 36.3 | 35.9 |

As shown in the above Table 2, the treated imprinting felt substantially increases both water absorption and bulk without a decrease in productivity or a significant loss in paper strength.

EXAMPLE 3

On a Crescent Former pilot machine, a polyurethane treated imprinting fabric was used to make a highly absorbent paper. The machine conditions were as follows:

| | |
|---|---|
| Type: | Crescent Former with Yankee dryer |
| Speed: | 1800 ft/min |
| Imprinting Felt Width | 32 inches |
| Imprinting Felt Length | 146 ft |

The following is a description of the treated imprinting felt.

The base fabric was similar to that described in Example 1 with about 100 g/m$^2$ of 20 micron in diameter batting nylon batting applied to the sheet side of the fabric and about 300 g/m$^2$ applied to the machine side. The base fabric was woven to create a prominent knuckle in the CD direction with the CD strands going over 2 MD strands and then under 2 MD strands. The base fabric had a CD strand count on the sheet side of 19 per inch. This fabric was treated on the sheet side with polyurethane in a manner similar to that described in Example 2.

This fabric was run on the Crescent Former machine with a furnish containing 70% Northern Hardwood Kraft fiber and 30% Northern Softwood Kraft fiber. To determine the effect of this fabric on paper sheet properties and productivity, a control fabric was also run. Because of felt conditioning before sheet formation and because of a suction pressure roll at the felt-Yankee nip, it was not necessary to further condition the felt with the wet sheet attached as was done in Examples 1 and 2.

After drying on the Yankee dryer, the sheets were creped off. Both the control and treated imprinting felt provided adequate dewater and there was no need to decrease machine speed for the treated felt. The physical properties of the creped sheets are shown below.

TABLE 3

At a target weight of 15.3 lb/3000 sq ft

| Property | Control (I) | Treated Imprinting Felt (I) |
|---|---|---|
| Basis Weight lb/3000 sq ft (air dried) | 15.6 | 15.5 |
| MD dry tensile g/3-inch | 2600 | 2035 |
| CD dry tensile g/3-inch | 1454 | 1218 |
| MD wet tensile g/3-inch | 819 | 572 |
| CD wet tensile g/3-inch | 377 | 296 |
| Caliper mils/8-sheets | 42.6 | 53.8 |
| Water Absorption g water/g solids | 4.12 | 5.13 |

TABLE 4

At a target weight of 16.8 lb/3000 sq ft

| Property | Control (II) | Treated Imprinting Felt (II) |
|---|---|---|
| Basis Weight lb/3000 sq ft (air dried) | 17.1 | 17.3 |
| MD dry tensile g/3-inch | 1863 | 1803 |
| CD dry tensile g/3-inch | 1101 | 1024 |
| MD wet tensile g/3-inch | 512 | 573 |
| CD wet tensile g/3-inch | 262 | 257 |
| Caliper mils/8-sheets | 52.6 | 54.3 |
| Water Absorption g water/g solids | 4.77 | 4.82 |

As shown in the above Tables 3 and 4, using the treated imprinting felt increases both water absorption and bulk in the resultant paper sheet without a substantial decrease in productivity or a significant reduction in strength.

EXAMPLE 4

The base sheets produced in Ex. 3 were converted to 29 and 32 lb/3000 sq ft. two-ply paper products. The converting process consisted of embossing the base sheets, applying glue, and marrying the base sheets into a two-ply product.

TABLE 5

| Property | Control (II) | Treated Imprinting Felt (I) |
|---|---|---|
| Basis Weight lb/3000 sq ft (air dried) | 32.1 | 29.2 |
| MD dry tensile g/3-inch | 3306 | 3519 |
| CD dry tensile g/3-inch | 1580 | 1605 |
| MD wet tensile g/3-inch | 959 | 1228 |
| CD wet tensile g/3-inch | 419 | 443 |
| Caliper mils/8-sheets | 154 | 157 |
| Water Absorption g water/sq meter | 274 | 268 |

The above data on the converted paper shows that the use of the treated imprinting felt allows the basis weight of the two-ply product to be reduced without a substantial loss in physical properties.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A method of making a paper base sheet comprising:

applying a wet web to an imprinting felt, wherein said imprinting felt has two sides and has a batting on at least a sheet side of said imprinting felt, said imprinting felt having been treated with a polymer in an amount of from 1 to about 50% by weight of the base fabric and batting, and wherein the combined weight of the sheet side batting and polymer is between 15 and 150 g/m$^2$;

pressing said wet web onto a dryer surface; and removing said web from the dryer surface.

2. The method according to claim 1, wherein vacuum is applied to the imprinting felt prior to pressing of the wet web onto the dryer surface.

3. The method according to claim 2, wherein the wet web is first applied to a forming wire and transferred from the forming wire to the imprinting felt and wherein the speed of the imprinting felt is 0 to 10% slower than the speed of the forming wire.

4. The method according to claim 1, wherein upon application of the wet web to the imprinting felt, the wet web has a percent solids of from about 5% to about 15% by weight.

5. The method according to claim 1, wherein upon application of the wet web to the drying surface, the wet web has a percent solids of from about 30% to about 50%.

6. The method according to claim 1, wherein the wet web is first applied to a forming wire and transferred from the forming wire to the imprinting felt and wherein the speed of the imprinting felt is 0 to 10% slower than the speed of the forming wire.

* * * * *

UNITED STATES PATENT AND TRADEMARK OFFICE

CERTIFICATE OF CORRECTION

PATENT NO. : 5,591,305
DATED : John H. Cameron
INVENTOR(S) : January 7, 1997

It is certified that error appears in the above-identified patent and that said Letters Patent is hereby corrected as shown below:

In the drawings,

The Title page should be deleted and substitute therefor the attached title page.

United States Patent [19]

Cameron

[11] Patent Number: 5,591,305

[45] Date of Patent: Jan. 7, 1997

[54] IMPRINTING FELT AND METHOD OF USING THE SAME

[75] Inventor: John H. Cameron, Appleton, Wis.

[73] Assignee: The James River Corporation of Virginia, Richmond, Va.

[21] Appl. No.: 415,048

[22] Filed: Mar. 31, 1995

Related U.S. Application Data

[62] Division of Ser. No. 252,449, Jun. 1, 1994.

[51] Int. Cl.[6] ..... D21H 11/00

[52] U.S. Cl. ..... 162/117; 162/109; 162/111

[58] Field of Search ..... 162/109, 117, 162/113, 111, 188; 428/154

[56] References Cited

U.S. PATENT DOCUMENTS

| | | | |
|---|---|---|---|
| 1,536,533 | 5/1925 | Sheehan . | |
| 2,038,712 | 4/1936 | Brodin . | |
| 3,059,312 | 10/1962 | Jamieson . | |
| 3,102,836 | 9/1963 | Griswold . | |
| 3,301,746 | 1/1967 | Sanford et al. . | |
| 3,399,111 | 8/1968 | Beaumont et al. . | |
| 3,537,954 | 11/1970 | Justus . | |
| 3,549,742 | 12/1970 | Benz . | |
| 3,617,442 | 11/1971 | Hurschman . | |
| 4,251,928 | 2/1981 | Rotar et al. . | |
| 4,271,222 | 6/1981 | Hahn . | |
| 4,300,982 | 11/1981 | Romanski . | |
| 4,357,386 | 11/1982 | Luciano et al. . | |
| 4,421,600 | 12/1983 | Hostetler . | |
| 4,440,597 | 4/1984 | Wells et al. | 162/111 |
| 4,514,345 | 4/1985 | Johnson et al. | 264/22 |
| 4,528,239 | 7/1985 | Trokan | 428/247 |
| 4,529,643 | 7/1985 | Lundstrom . | |
| 4,533,437 | 8/1985 | Curran et al. . | |
| 4,571,359 | 2/1986 | Dutt . | |
| 4,657,806 | 4/1987 | Dutt . | |
| 4,830,905 | 5/1989 | Gulya et al. . | |
| 4,834,838 | 5/1989 | Klowak | 162/111 |
| 4,868,032 | 9/1989 | Eian et al. . | |
| 4,931,010 | 6/1990 | Barnwell . | |
| 4,981,745 | 1/1991 | Lefkowitz | 428/147 |
| 5,156,843 | 10/1992 | Leong et al. . | |
| 5,207,873 | 5/1993 | Sandieja et al. . | |
| 5,232,768 | 8/1993 | Eklund et al. . | |
| 5,328,757 | 7/1994 | Kenney et al. . | |
| 5,346,567 | 9/1994 | Barnwell . | |

FOREIGN PATENT DOCUMENTS

| | | | |
|---|---|---|---|
| 1455843 | 4/1974 | United Kingdom | 162/900 |
| 9210607 | 6/1992 | WIPO | 162/900 |

*Primary Examiner*—Brenda A. Lamb

*Attorney, Agent, or Firm*—Finnegan, Henderson, Farabow, Garrett & Dunner, L.L.P.

[57] ABSTRACT

The felt disclosed is a base fabric which is covered with a low level of batting and which is treated with a polymer. A papermaking machine and method of using the machine which employs a felt that simultaneously imprints and dewaters a wet paper web as the web is deposited on a cylindrical drying surface.

6 Claims, 6 Drawing Sheets

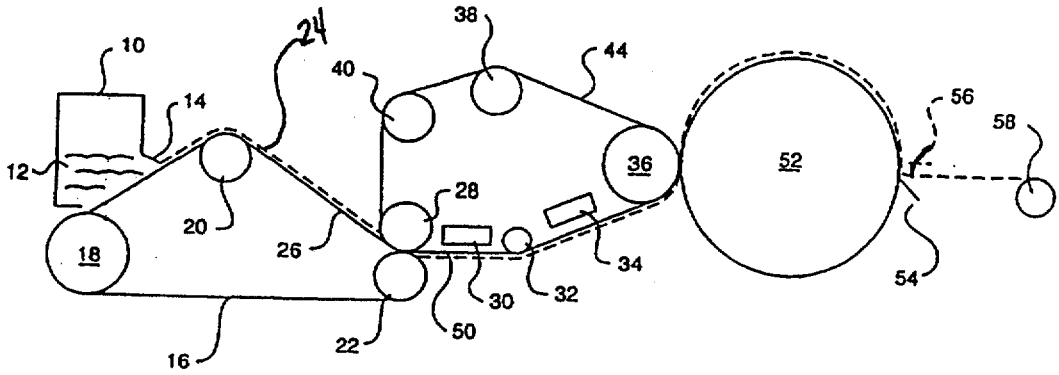

UNITED STATES PATENT AND TRADEMARK OFFICE

CERTIFICATE OF CORRECTION

PATENT NO. : 5,591,305

DATED : January 7, 1997

INVENTOR(S) : John H. CAMERON

It is certified that error appears in the above-identified patent and that said Letters Patent is hereby corrected as shown below:

Fig. 1, the number "24" was omitted, and the line associated with number 56 should be pointing to the dried paper web after creping, as illustrated below:

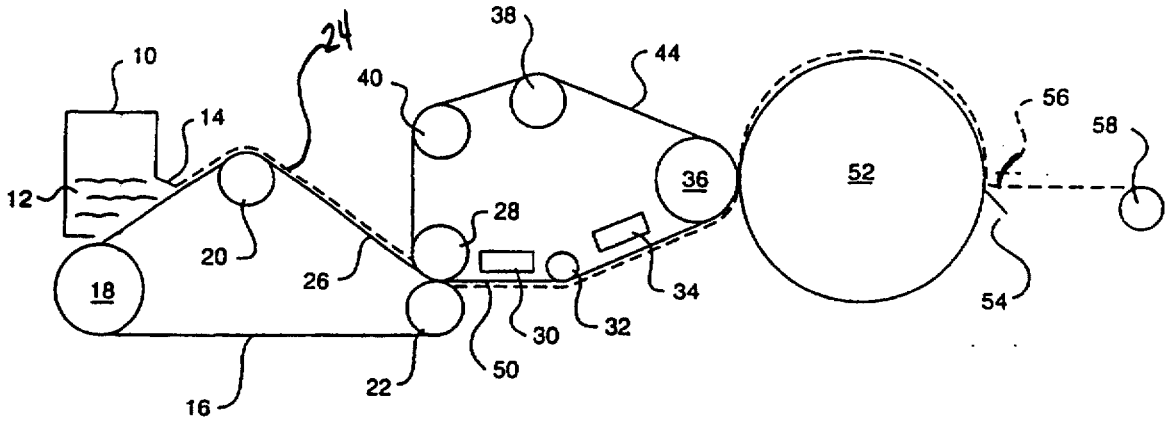

*FIG. 1*

UNITED STATES PATENT AND TRADEMARK OFFICE

CERTIFICATE OF CORRECTION

PATENT NO. : 5,591,305

DATED : January 7, 1997

INVENTOR(S) : John H. CAMERON

It is certified that error appears in the above-identified patent and that said Letters Patent is hereby corrected as shown below:

Fig. 2, the symbols on the chart are incorrectly associated with the labels, and the labels are incorrect. See new Fig. 2 below:

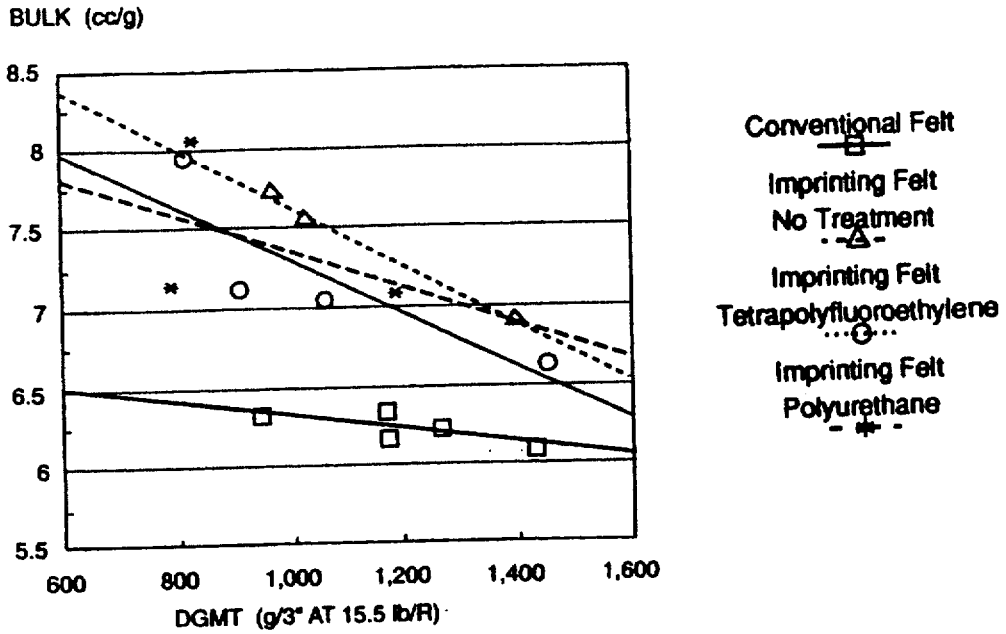

*FIG. 2*

UNITED STATES PATENT AND TRADEMARK OFFICE

CERTIFICATE OF CORRECTION

PATENT NO. : 5,591,305

DATED : January 7, 1997

INVENTOR(S) : John H. CAMERON

It is certified that error appears in the above-identified patent and that said Letters Patent is hereby corrected as shown below:

Fig. 3, change "POLYTETRAFLOURETHYLENE" to --POLYTETRAFLUORETHYLENE" (both occurrences), change "FLET" to --FELT--, and change "=" to --+-- (both occurrences).

Fig. 4, change "POLYTETRAFLOURETHYLENE" to --POLYTETRAFLUORETHYLENE".

Fig. 5, change "POLYTETRAFLOURETHYLENE" to --POLYTETRAFLUORETHYLENE", and correct the labels to Fig. 5, as illustrated below:

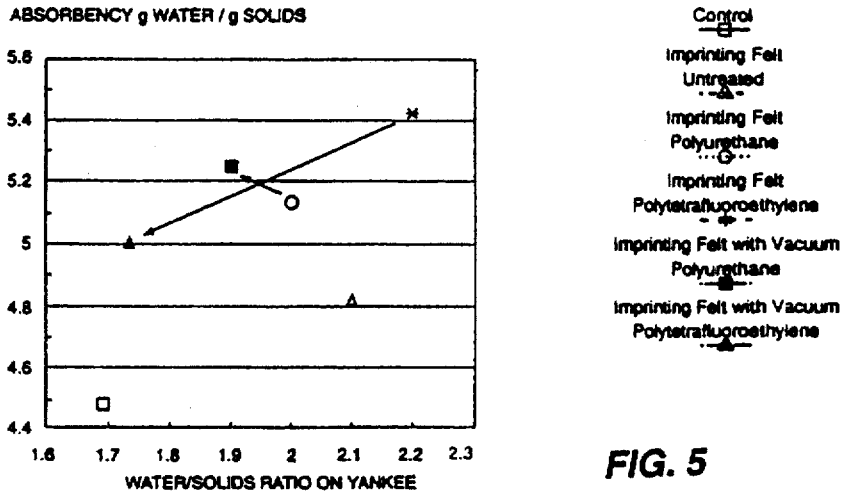

FIG. 5

UNITED STATES PATENT AND TRADEMARK OFFICE

CERTIFICATE OF CORRECTION

PATENT NO. : 5,591,305

DATED : January 7, 1997

INVENTOR(S) : John H. CAMERON

It is certified that error appears in the above-identified patent and that said Letters Patent is hereby corrected as shown below:

Column 2, line 6, change "yanker" to --Yankee--.

Column 5, line 48, change "unacceptable" to --unacceptably--; and
line 57, change "to" to --embodiment of--.

Column 7, lines 17, 19, 22, 25, and 28, change "caliper" to --bulk--.

Column 10, line 33, change "dewater" to --dewatering--.

Signed and Sealed this

Twenty-seventh Day of July, 1999

*Attest:*

Q. TODD DICKINSON

*Attesting Officer*

*Acting Commissioner of Patents and Trademarks*